US010267072B2

(12) United States Patent
Yoshino et al.

(10) Patent No.: US 10,267,072 B2
(45) Date of Patent: Apr. 23, 2019

(54) DOOR HANDLE APPARATUS FOR VEHICLE

(71) Applicant: Aisin Seiki Kabushiki Kaisha, Kariya-shi (JP)

(72) Inventors: Masaki Yoshino, Chita-gun (JP); Koichi Nagata, Chiryu (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 766 days.

(21) Appl. No.: 14/747,254

(22) Filed: Jun. 23, 2015

(65) Prior Publication Data

US 2016/0032627 A1 Feb. 4, 2016

(30) Foreign Application Priority Data

Jul. 30, 2014 (JP) ..... 2014-154590

(51) Int. Cl.
*E05B 85/16* (2014.01)
*E05B 79/06* (2014.01)
*E05B 85/10* (2014.01)

(52) U.S. Cl.
CPC ..... *E05B 85/16* (2013.01); *E05B 79/06* (2013.01); *E05B 85/10* (2013.01)

(58) Field of Classification Search
CPC ..... E05B 85/10
USPC ..... 292/336.3
See application file for complete search history.

(56) References Cited

U.S. PATENT DOCUMENTS 6,363,577 B1 4/2002 Spitzley
6,910,303 B1 * 6/2005 Mathofer ..... E05B 85/16 49/503
7,344,168 B2 * 3/2008 Matsubara ..... E05B 79/06 292/336.3

(Continued)

FOREIGN PATENT DOCUMENTS

EP 1 839 958 A1 10/2007
EP 1 895 080 A2 3/2008

(Continued)

OTHER PUBLICATIONS

Extended European Search Report dated Dec. 15, 2015 in Patent Application No. 15179141.5.

*Primary Examiner* — Carlos Lugo
(74) *Attorney, Agent, or Firm* — Oblon, McClelland, Maier & Neustadt, L.L.P.

(57) ABSTRACT

A door handle apparatus for a vehicle includes a frame member, a handle body including a handle shaft portion, a bearing member including first and second holding portions arranged away from each other in a rotation axis direction of the handle shaft portion held at the bearing member and defining a holding void for holding the handle shaft portion, the bearing member being supported at the frame member in a state where the bearing member is rotatable between an assembly completion position and an assembly ready position, and a holding release inhibition mechanism inhibiting a release of a state where the handle shaft portion is held at the holding void by restricting an operation of at least one of the first and second holding portions in a case where the handle body receives a load in a predetermined direction while the bearing member is at the assembly completion position.

7 Claims, 8 Drawing Sheets

(56) References Cited

U.S. PATENT DOCUMENTS

| | | | | |
|---|---|---|---|---|
| 7,827,736 | B2 * | 11/2010 | Sunahara | E05B 85/16 292/336.3 |
| 8,157,301 | B2 * | 4/2012 | Sunahara | E05B 85/16 292/336.3 |
| 8,459,706 | B2 * | 6/2013 | Yoshino | E05B 79/06 292/336.3 |
| 8,777,281 | B2 * | 7/2014 | Saitou | E05B 79/06 292/336.3 |
| 2007/0228768 | A1 | 10/2007 | Kobayashi | |
| 2008/0047203 | A1 | 2/2008 | Sunahara et al. | |
| 2011/0016670 | A1 | 1/2011 | Sunahara et al. | |
| 2011/0042973 | A1 | 2/2011 | Yoshino et al. | |
| 2012/0139271 | A1 | 6/2012 | Saitou | |

FOREIGN PATENT DOCUMENTS

| | | |
|---|---|---|
| EP | 2 290 176 A2 | 3/2011 |
| JP | 2005-76367 | 3/2005 |
| JP | 2008-50870 | 3/2008 |

* cited by examiner

DOOR HANDLE APPARATUS FOR VEHICLE

CROSS REFERENCE TO RELATED APPLICATIONS

This application is based on and claims priority under 35 U.S.C. § 119 to Japanese Patent Application 2014-154590, filed on Jul. 30, 2014, the entire content of which is incorporated herein by reference.

TECHNICAL FIELD

This disclosure generally relates to a door handle apparatus for a vehicle.

BACKGROUND DISCUSSION

A known door handle apparatus for a vehicle (hereinafter also simply referred to as a door handle apparatus) mounted to a vehicle door is disclosed, for example, in JP2008-50870A. The aforementioned door handle apparatus includes a handle body, a frame member assembled from a vehicle inner side on a door outer panel that constitutes an outer surface of a vehicle door, and a bearing member made of resin and assembled on the frame member to hold a handle shaft portion of the handle body. The bearing member includes a pair of holding portions (grasping portions) disposed away from each other to define a holding void for holding the handle shaft portion. In addition, the bearing member is supported at the frame member so as to be rotatable between an assembly ready position and an assembly completion position. In the assembly ready position of the bearing member, the handle shaft portion is insertable into the holding void and is removable or disengageable from the holding void. In the assembly completion position of the bearing member, the handle shaft portion is restricted from being removed from the holding void. Therefore, the handle body is assembled on the frame member via the bearing member by a rotation of the bearing member from the assembly ready position to the assembly completion position in a state where the handle shaft portion of the handle body is set to the bearing member in the assembly ready position.

According to the door handle apparatus including the aforementioned construction, it is assumed that an excessive load is applied to the handle body in a vehicle rear direction. Such state may occur at a time of vehicle theft or during a normal door opening and closing operation where a user holds or retains the handle body with one's hand and fingers, for example. In this case, each of the holding portions of the bearing member is biased in the vehicle rear direction by the handle shaft portion of the handle body. Thus, the pair of holding portions may be elastically deformed in the vehicle rear direction. At this time, in a case where one of and the other of the holding portions separate from each other to thereby expand the holding void, i.e., an opening state of the bearing member is formed, the handle shaft portion of the handle body disengages or separates from the holding void and thus the holding of the handle shaft portion by the bearing member is released. In addition, the bearing member in the assembly completion position may possibly rotate to the assembly ready position by a load applied to each of the holding portions when the handle shaft portion of the handle body disengages or separates from the holding void. In this case, the holding of the handle shaft portion by the bearing member is also released because of the separation of the handle shaft portion of the handle body from the holding void. As a result, malfunctions such as an occurrence of looseness at the handle body and a disengagement of the handle body from the door outer panel, for example, may occur.

A need thus exists for a door handle apparatus for a vehicle which is not susceptible to the drawback mentioned above.

SUMMARY

According to an aspect of this disclosure, a door handle apparatus for a vehicle includes a frame member configured to be assembled on a door outer panel that constitutes an outer surface of a vehicle door, a handle body including an arm portion that extends towards the frame member and that includes a handle shaft portion, the handle body being rotatable relative to the frame member at the handle shaft portion, a bearing member assembled on the frame member and holding the handle shaft portion of the handle body, the bearing member being made of resin, the bearing member including first and second holding portions arranged away from each other in a rotation axis direction of the handle shaft portion that is held at the bearing member and defining a holding void for holding the handle shaft portion, the bearing member being supported at the frame member in a state where the bearing member is rotatable between an assembly completion position at which a disengagement of the handle shaft portion from the holding void is restricted and an assembly ready position at which the disengagement of the handle shaft portion from the holding void is inhibited from being restricted, and a holding release inhibition mechanism inhibiting a release of a state where the handle shaft portion is held at the holding void by restricting an operation of at least one of the first and second holding portions in a case where the handle body receives a load in a predetermined direction along an extending direction of the handle body while the bearing member is at the assembly completion position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
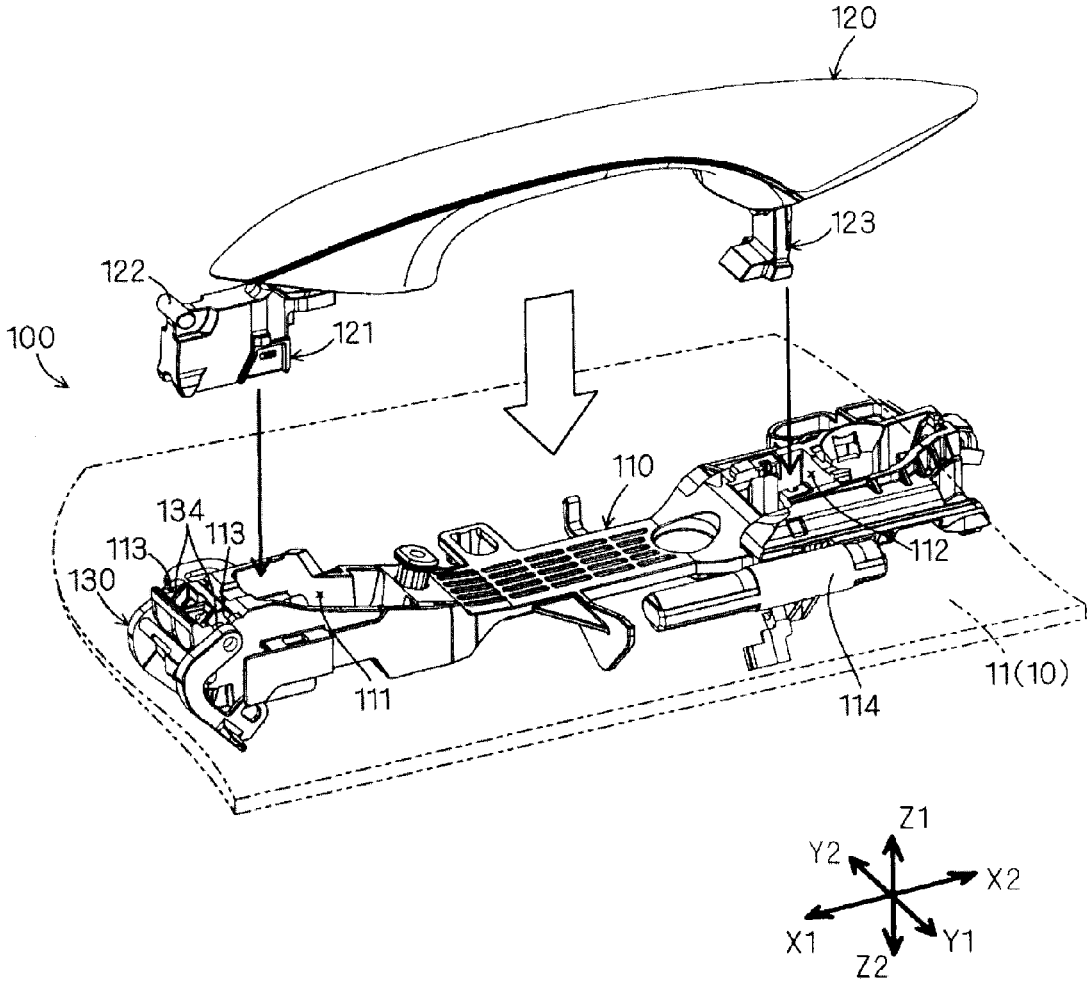
FIG. 1 is an exploded perspective view illustrating a frame member and a handle body of a door handle apparatus for a vehicle according to an embodiment disclosed here.

An embodiment is explained with reference to the attached drawings. In the drawings, a vehicle front direction and a vehicle rear direction are indicated by an arrow X1 and an arrow X2, respectively. A vehicle upper direction and a vehicle lower direction are indicated by an arrow Y1 and an arrow Y2, respectively. A vehicle outer direction and a vehicle inner direction are indicated by an arrow Z1 and an arrow Z2, respectively. The aforementioned directions may be applied to a door handle apparatus for a vehicle (hereinafter also simply referred to as a door handle apparatus) in a state before and after the door handle apparatus is mounted to a vehicle door.

As illustrated in FIG. 1, in the embodiment, a door handle apparatus 100 is mounted to a vehicle door 10, specifically, to a door outer panel 11 constituting a portion of the vehicle door 10. The door outer panel 11 is constituted as a metal door panel in the vehicle door 10 extending in the vehicle outer direction. The door handle apparatus 100 is configured as an assembly (also referred to as an assay) where plural components are integrally assembled. The plural components include a frame member 110, a handle body 120 and a bearing member 130.

The frame member 110 is an elongated member extending in the vehicle front direction X1 and the vehicle rear direction X2, i.e., along a front-rear direction of the vehicle, and is mounted to the door outer panel 11 of the vehicle door 10. The frame member 110 functions as holding the handle body 120 by engaging with the handle body 120. An insertion hole 111 is formed at a front end portion of the frame member 110 so as to penetrate therethrough while an insertion hole 112 is formed at a rear end portion of the frame member 110 so as to penetrate therethrough. An engagement portion of the handle body 120 provided to engage with the frame member 110 is configured to protrude towards a vehicle inner side from a vehicle outer side by passing through a penetration hole formed at the door outer panel 11 of the vehicle door 10 and the insertion holes 111, 112 formed at the frame member 110.

Opening portions 113, 113 are formed to open at a pair of frame wall portions arranged in the vicinity of the insertion hole 111 of the frame member 110. The frame wall portions are disposed away from each other in the vehicle upper direction Y1 and the vehicle lower direction Y2, i.e., in an up-down direction of the vehicle. The opening portions 113, 113 are configured as bearings for rotatably supporting a pair of support shaft portions 134, 134 of the bearing member 130, respectively. Each of the opening portions 113 is configured to open to the vehicle outer side and to include an opening width corresponding to a shaft diameter of each of the support shaft portions 134. Therefore, the bearing member 130 is specified at an assembly ready position relative to the frame member 110 in a state where each of the support shaft portions 134 of the bearing member 130 is fitted in each of the opening portions 113 of the frame member 110 from the vehicle outer side (i.e., from an upper side in FIG. 1). Afterwards, the bearing member 130 is specified at an assembly completion position as a final stage by a rotation of the bearing member 130 around the support shaft portions 134 in a state where the bearing member 130 is supported by the frame member 110 via the opening portions 113. The frame member 110 serves as a frame member.

The handle body 120 is configured as an elongated grip-type handle portion (also called an outside handle) extending along the arrows X1 and X2 in the front-rear direction of the vehicle in the same way as the frame member 110. A user may hold or grip the handle body 120 with one's hand and fingers to selectively open and close the vehicle door 10. The handle body 120 serves as a handle body.

An engagement arm 121 is provided at a front end portion of the handle body 120 so as to be inserted into the insertion hole 111 of the frame member 110. The engagement arm 121 serves as an arm portion. The engagement arm 121 includes a handle shaft portion 122 in a column form extending along the arrows Y1 and Y2 in the up-down direction of the vehicle. The handle body 120 is rotatably mounted to the bearing member 130 via the handle shaft portion 122. That is, the handle shaft portion 122 serves as a rotation center of the handle body 120. The handle body 120 is rotatably mounted to the frame member 110 via the bearing member 130 accordingly. Thus, in a state where the bearing member 130 is integrally assembled on the frame member 110, the handle body 120 is rotatable in the vehicle outside direction Z1 and the vehicle inside direction Z2 around the handle shaft portion 122.

Figure 2:
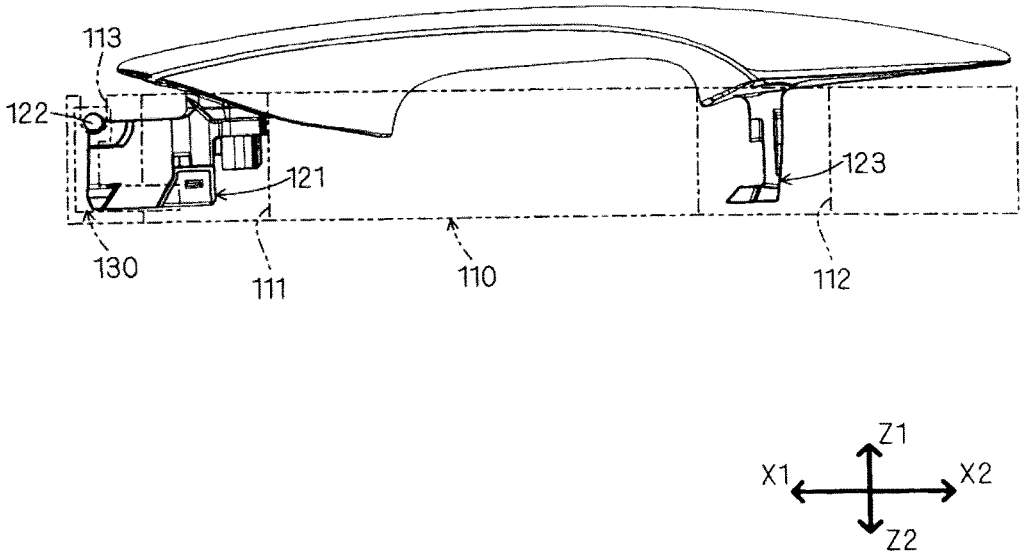
FIG. 2 is a side view of the door handle apparatus in a state where the handle body is in an initial position.
Figure 3:
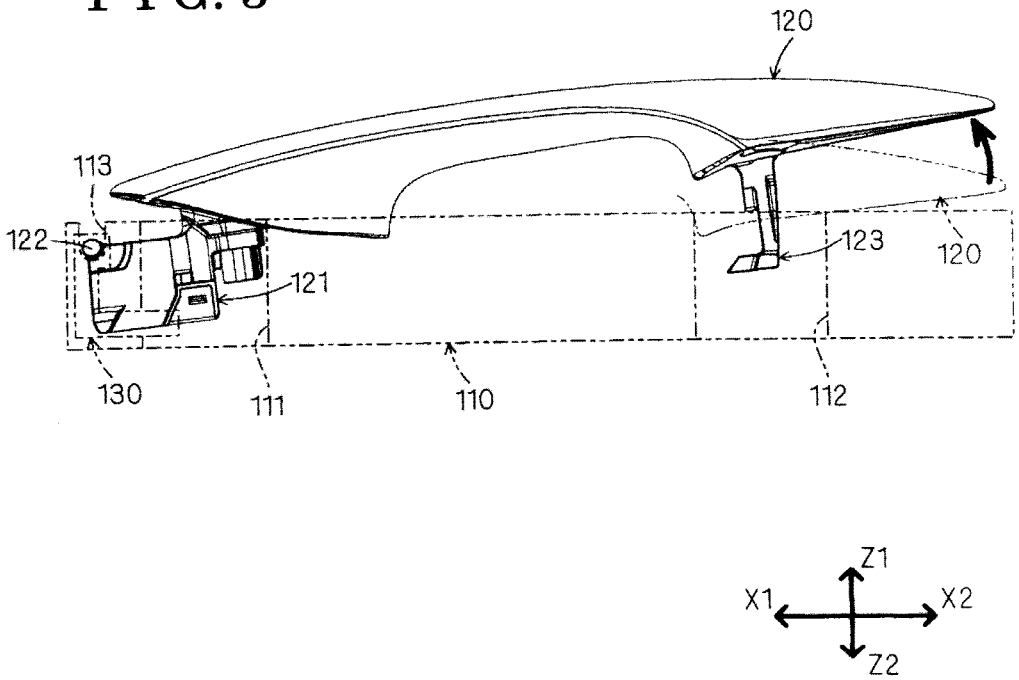
FIG. 3 is a side view of the door handle apparatus in a state where the handle body is in a full stroke position.

An engagement leg portion 123 is provided at a rear end portion of the handle body 120 so as to be inserted into the insertion hole 112 of the frame member 110. The engagement leg portion 123 includes a substantially L-shaped cross section and engages with a lever member (counterweight) 114 that is rotatably supported at the frame member 110. The lever member 114 is connected to a coil spring for pulling the engagement leg portion 123 in the vehicle inside direction Z2 and also connected to a door lock mechanism via a connection rod. Accordingly, in a case where the handle body 120 rotates from an initial position as illustrated in FIG. 2 to a full stroke position as illustrated in FIG. 3 around the handle shaft portion 122, the engagement leg portion 123 rotates in the vehicle outer direction Z1 against an elastic biasing force of the coil spring, thereby switching the door lock mechanism from a locked state to an unlocked state.

A construction of the bearing member 130 assembled on the frame member 110 is explained in detail with reference to FIGS. 4 to 9.

Figure 4:
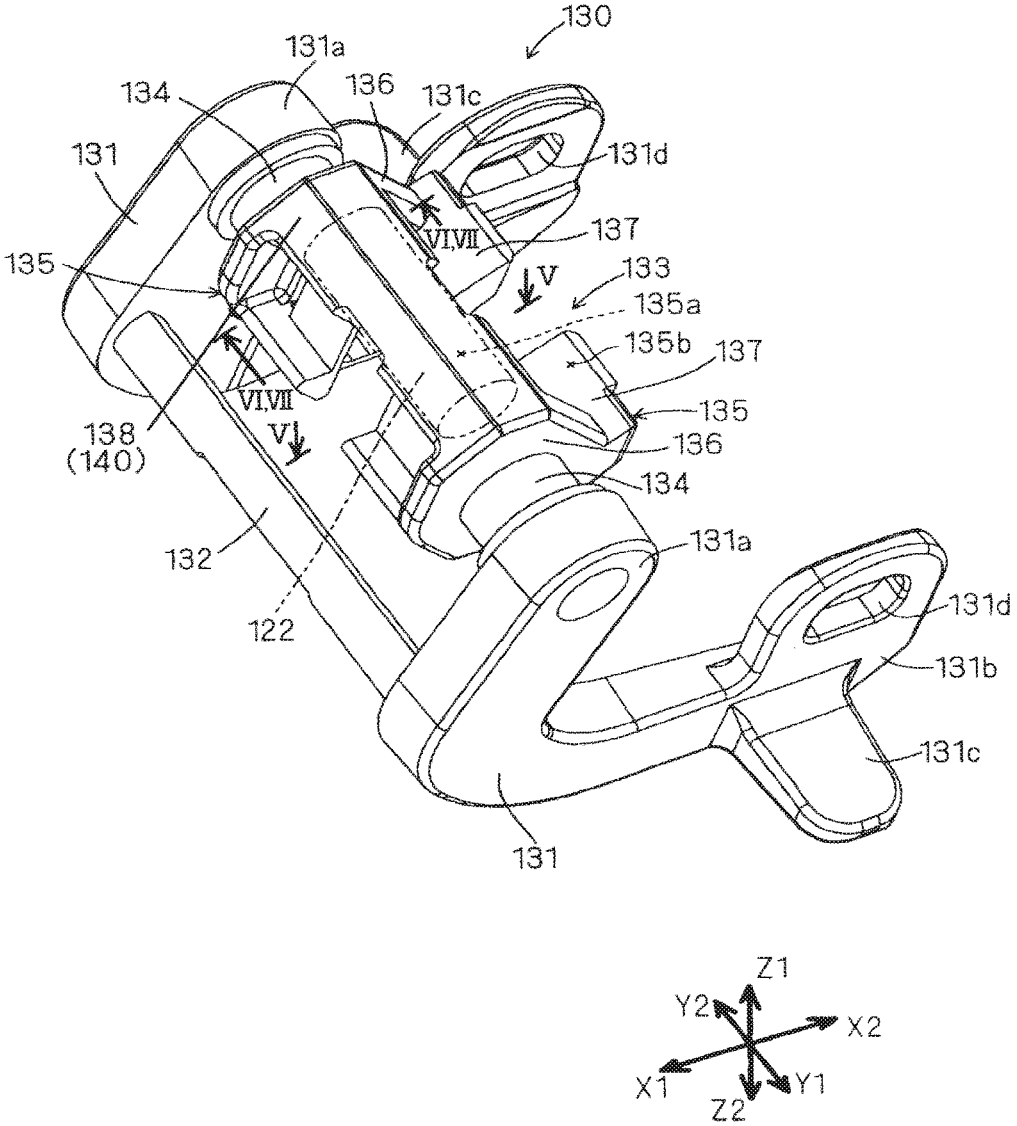
FIG. 4 is a perspective view of a bearing member illustrated in FIG. 1.

As illustrated in FIG. 4, the bearing member 130 is a resin-made member integrally formed of a hard synthetic resin material. The bearing member 130 functions as holding the handle shaft portion 122 of the handle body 120. The bearing member 130 serves as a bearing member. The bearing member 130 includes a pair of movable arms 131, 131 disposed away from each other along the arrows Y1 and Y2 in the up-down direction of the vehicle. The pair of movable arms 131, 131 is connected to each other via a first connection structure 132 and a second connection structure 133 each of which extends along the arrows Y1 and Y2 in the up-down direction of the vehicle.

The first connection structure 132 is configured as a connection frame connecting the pair of movable arms 131, 131 each other within a region between a first end portion 131*a* and a second end portion 131*b* of each of the movable arms 131. An operation portion 131*c* and an opening portion 131*d* are provided at the second end portion 131*b* of each of the movable arms 131. The operation portion 131*c* is configured as an operation portion operated in a case where the bearing member 130 rotates from the assembly ready position to the assembly completion position. The opening portion 131*d* is formed to open so as to fit in an engagement portion formed at the frame member 110 when the bearing member 130 is in the assembly completion position.

The second connection structure 133 is configured to connect the pair of movable arms 131, 131 each other within a range of the first end portion 131*a* of each of the movable arms 131. The second connection structure 133 includes the pair of support shaft portions 134, 134, a pair of holding portions 135, 135 serving as first and second holding portions, and a connection portion 138. One of the movable arms 131 is fixed to a first side of one of the support shaft portions 134. Then, one of the holding portions 135 is fixed to a second side of one of the support shaft portions 134 opposite from the first side where one of the movable arms 131 is fixed. In the same manner, the other of the movable arms 131 is fixed to a first side of the other of the support shaft portions 134 and then the other of the holding portions 135 is fixed to a second side of the other of the support shaft portions 134 opposite from the first side where the other of the movable arms 131 is fixed. That is, one of the support shaft portions 134 is arranged between one of the movable arms 131 and one of the holding portions 135 while the other of the support shaft portions 134 is arranged between the other of the movable arms 131 and the other of the holding portions 135.

Figure 5:
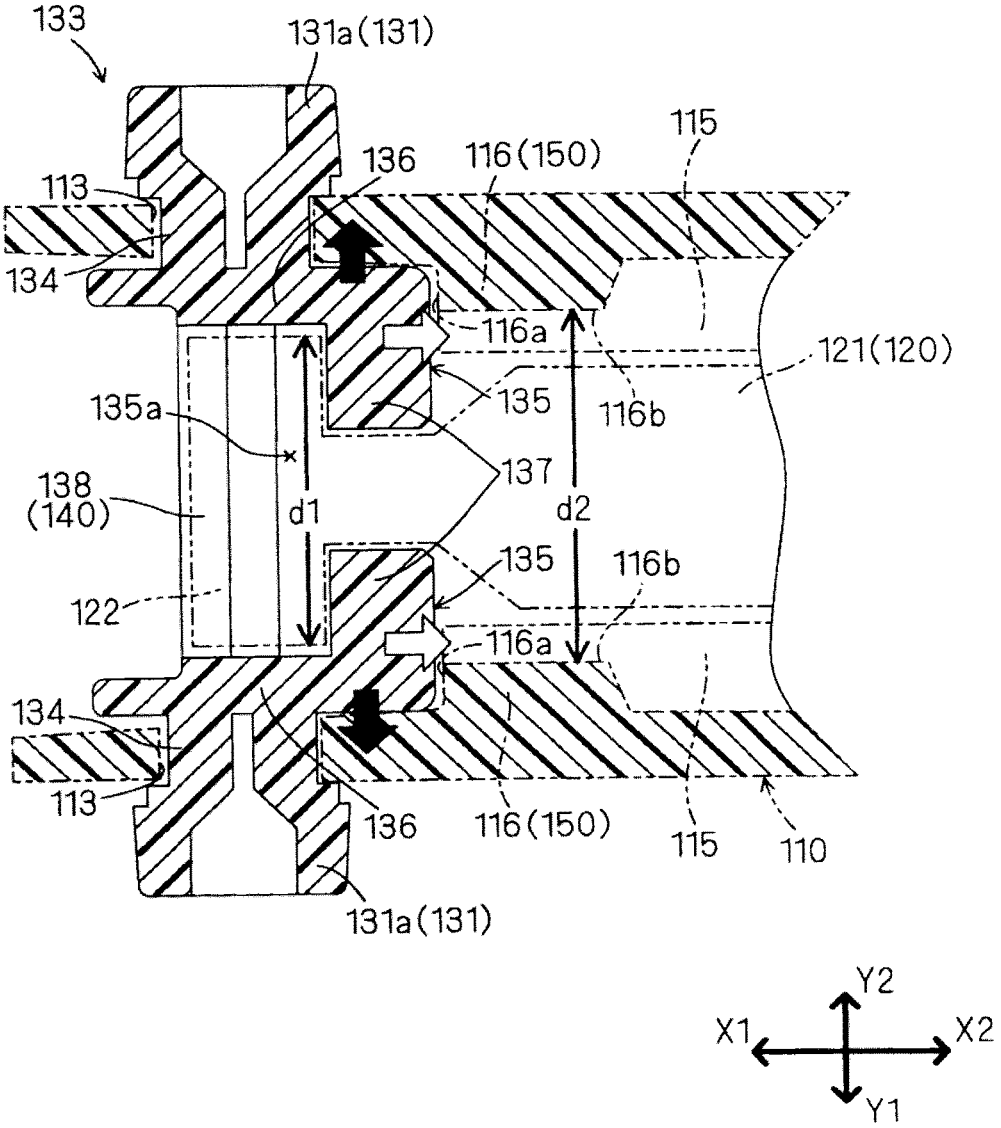
FIG. 5 is a cross-sectional view of the bearing member taken along a line V-V in FIG. 4.

As illustrated in FIG. 5, in order that the bearing member 130 is rotatable between the assembly ready position and the assembly completion portion both of which are specified beforehand, the support shaft portions 134, 134 are fitted in the respective opening portions 113, 113 of the frame member 110 so that the bearing member 130 is supported at the frame member 110. Thus, in a case where the bearing member 130 rotates around the pair of support shaft portions 134, the pair of movable arms 131, 131 and the pair of holding portions 135, 135 integrally rotate around the pair of support shaft portions 134, 134. The holding portions 135, 135 are arranged away from each other and facing each other along the arrows Y1 and Y2 in the up-down direction of the vehicle corresponding to a rotation axis direction of the handle shaft portion 122. Each of the holding portions 135 includes a side wall portion 136 extending along the arrows X1 and X2 in the front-rear direction of the vehicle and fixed to each of the movable arms 131, and a restriction wall portion 137 extending from the side wall portion 136. The connection portion 138 extends to be elongated along the arrows Y1 and Y2 in the up-down direction of the vehicle so as to connect the side wall portion 136 of one of the holding portions 135 and the side wall portion 136 of the other of the holding portions 135 each other. A void defined by the pair of holding portions 135, 135 and the connection portion 138 is configured as a holding void 135*a* for housing the handle shaft portion 122 provided at the engagement arm 121 of the handle body 120. The handle shaft portion 122 is insertable into the holding void 135*a* via an insertion opening 135*b*. Each of the restriction wall portions 137 functions as restricting the handle shaft portion 122 housed in the holding void 135*a* from separating or disengaging from the holding void 135*a* in the vehicle rear direction X2. Thus, the pair of holding portions 135, 135 holds or retains the handle shaft portion 122 at the holding void 135*a*. The pair of holding portions 135, 135 serves as a pair of holding portions.

Figure 6:
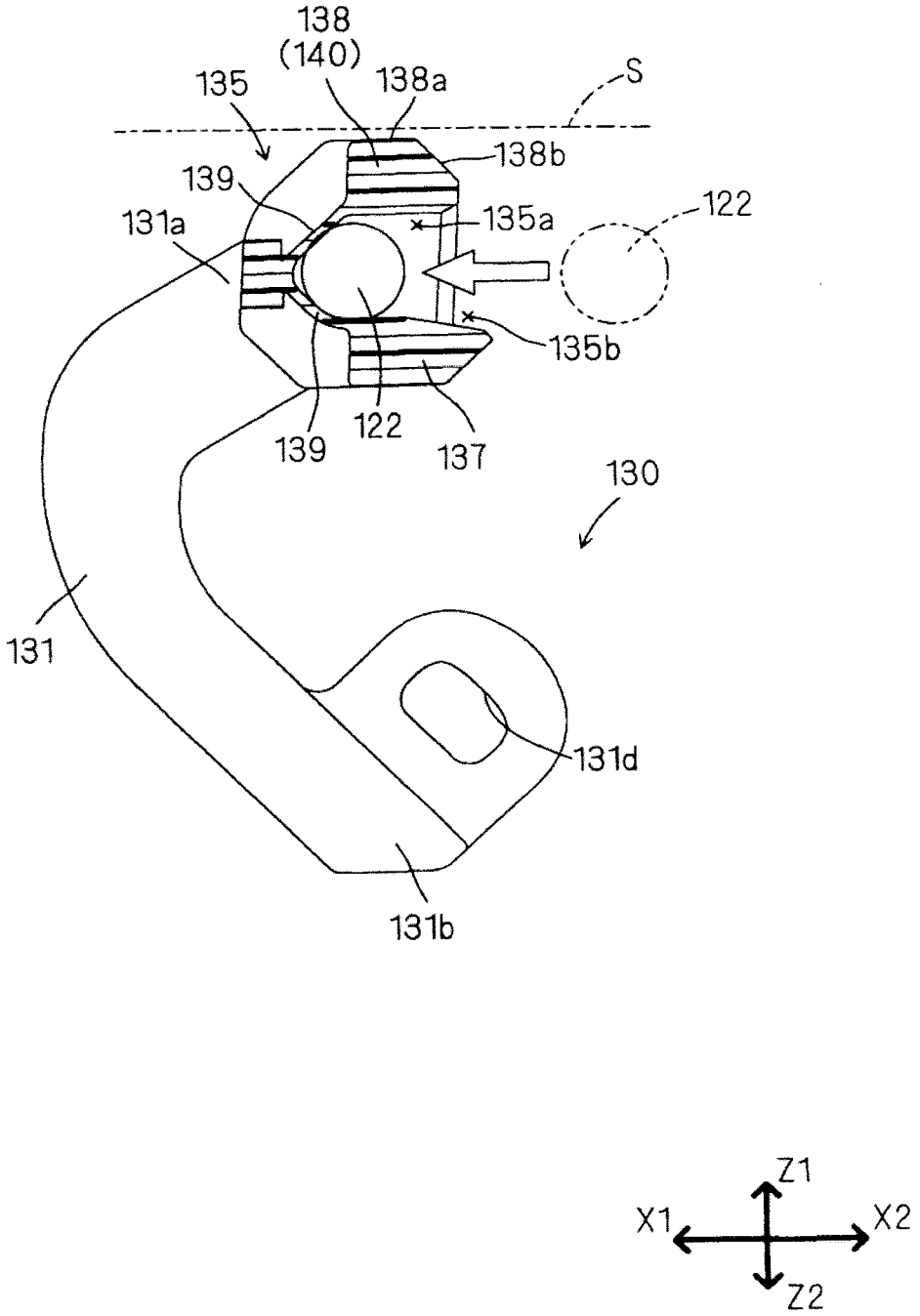
FIG. 6 is a cross-sectional view of the bearing member in an assembly ready position taken along a line VI-VI in FIG. 4.

As illustrated in FIG. 6, in a case where the bearing member 130 is at the assembly ready position, each of the holding portions 135 is configured to be arranged so that the insertion opening 135*b* opens in the vehicle rear direction X2. Thus, when the bearing member 130 is at the assembly ready position, the handle shaft portion 122 of the handle body 120 is insertable to the holding void 135*a* via the insertion opening 135*b* by sliding in the vehicle front direction X1 towards the insertion opening 135*b* from the vehicle rear side. In addition, in the assembly ready position of the bearing member 130, the handle shaft portion 122 of the handle body 120 may disengage or separate from the holding void 135*a* via the insertion opening 135*b* (i.e., disengagement operation of the handle shaft portion 122 from the holding void 135*a* is not restricted). The holding void 135*a* is defined and formed by a substantially C-shaped cross configuration obtained by the restriction wall portion 137 serving as a first wall portion, the connection portion 138 serving as a second wall portion, the restriction wall portion 137 and the connection portion 138 facing each other, and a thin wall portion 139 serving as a reduced wall portion extending between the restriction wall portion 137 and the connection portion 138 in each of the holding portions 135. In this case, a thickness of the thin wall portion 139 may be desirably specified so as to be smaller than a thickness of each of the restriction wall portion 137 and the connection portion 138 and so that a torsional deformation (elastic deformation) of the thin wall portion 139 is achieved by a contact between the thin wall portion 139 and the handle shaft portion 122. Accordingly, even in a case where variations in product size occurs at the handle shaft portion 122 that is housed in the holding void 135*a*, the thin wall portion 139 is preferentially deformed at a contact portion with the handle shaft portion 122 to thereby absorb the aforementioned variations. That is, the thin wall portion 139 produces an effect similar to a so-called plate spring. As a result, in a state where the handle body 120 is assembled on the frame member 110, a looseness of the handle shaft portion 122 may be inhibited.

Figure 7:
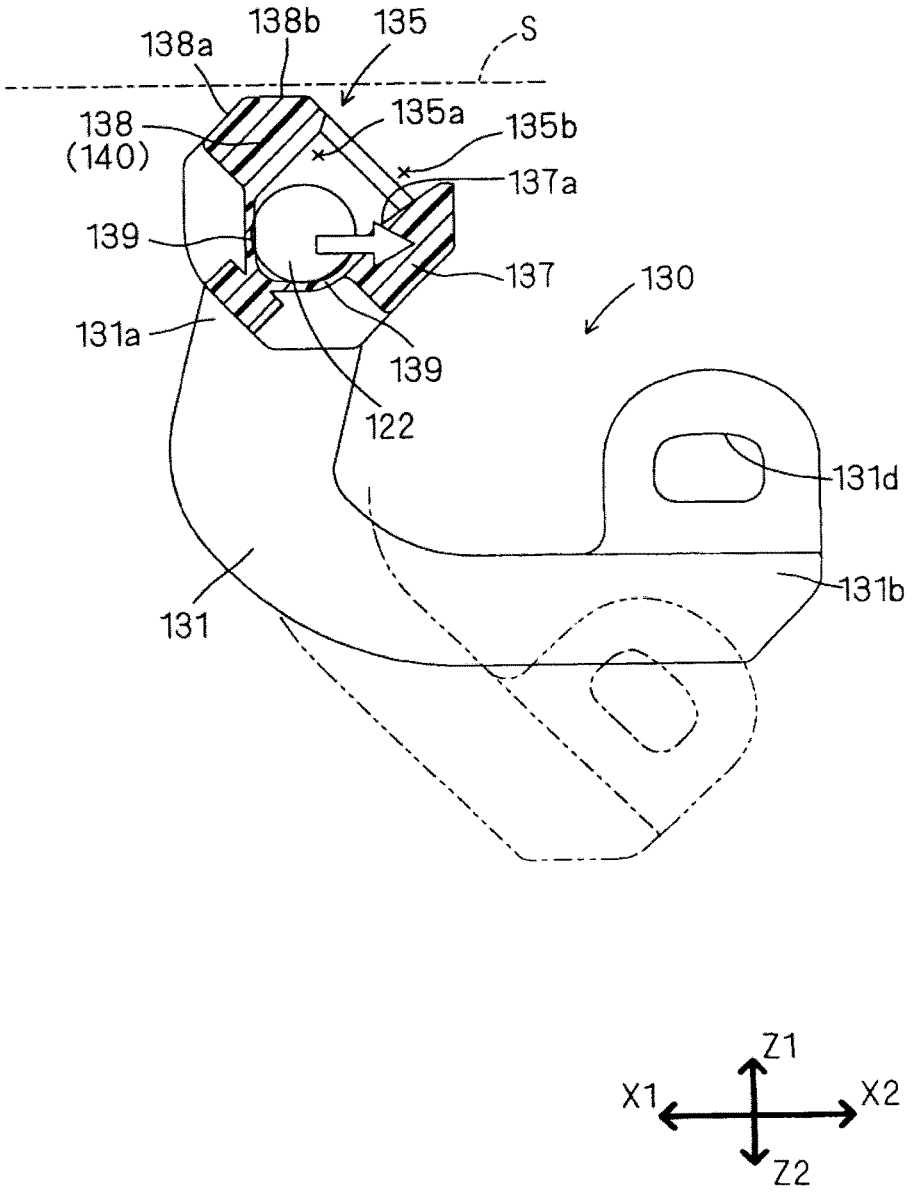
FIG. 7 is a cross-sectional view of the bearing member in an assembly completion position taken along a line VII-VII in FIG. 4.

Thereafter, in a case where the operation portion 131*c* of the movable arm 131 is operated so as to switch the position of the bearing member 130 from the assembly ready position to the assembly completion position, the restriction wall portion 137 of each of the holding portions 135 is positioned at the vehicle rear side relative to the handle shaft portion 122 housed in the holding void 135*a*. That is, as illustrated in FIG. 7, when the bearing member 130 is arranged at the assembly completion position, each of the holding portions 135 is configured to be arranged so that the insertion opening 135*b* opens further to the vehicle outer side as compared to a case where the bearing member 130 is arranged at the assembly ready position. In this case, an inner wall surface 137*a* (i.e., a facing surface facing the handle shaft portion 122 housed in the holding void 135*a*) of the restriction wall portion 137 extends in a direction intersecting with a sliding direction (in the vehicle front-rear direction) of the handle shaft portion 122. Thus, in a state where the bearing member 130 is in the assembly completion position, the handle shaft portion 122 that is in a state being housed in the holding void 135*a* makes contact with the inner wall surface 137*a* of the restriction wall portion 137, so that an operation (i.e., an operation indicated by a hollow arrow in FIG. 7) of the handle shaft portion 122 separating from the holding void 135*a* in the vehicle rear direction X2 is restricted by the restriction wall portion 137. As a result, the handle shaft portion 122 is in a holding state being held in the holding void 135*a* by the pair of holding portions 135, 135

The bearing member 130 is configured so that the connection portion 138 is positioned at a vehicle outermost side out of the components constituting the bearing member 130. Thus, in the present embodiment, in order to achieve a construction where the connection portion 138 of the bearing member 130 is inhibited from interfering with other members or components, a chamfer configuration where a vehicle exterior surface of the connection portion 138 is chamfered is employed. The chamfer configuration is achieved by a first plane 138*a* and a second plane 138*b* and defining the vehicle exterior surface. The first plane 138*a* is configured as a plane extending along the arrows X1 and X2 in the front-rear direction of the vehicle when the bearing member 130 is in the assembly ready position as illustrated in FIG. 6. On the other hand, the second plane 138*b* is configured as a plane extending along the arrows X1 and X2 in the front-rear direction of the vehicle when the bearing member 130 is in the assembly completion position as illustrated in FIG. 7. That is, in a case where the bearing member 130 is at the assembly ready position, the first plane 138*a* positioned at the vehicle outermost side in the vehicle exterior surface of the connection portion 138 is placed at the vehicle inner side relative to a reference surface S that defines an outermost portion at the vehicle outer side of the frame member 110. In addition, in a case where the bearing member 130 is at the assembly completion position, the second plane 138*b* positioned at the vehicle outermost side in the vehicle exterior surface of the connection portion 138 is placed at the vehicle inner side relative to the reference surface S. Accordingly, at least at two positions, i.e., at the assembly completion position and at the assembly ready position of the bearing member 130, the connection portion 138 is inhibited from projecting towards the vehicle outer side than the frame member 110. That is, the connection portion 138 is inhibited from projecting to the vehicle outer side than the reference surface S that defines the outermost portion at the vehicle outer side of the frame member 110. As a result, the connection portion 138 is inhibited from interfering with surrounding members of the connection portion 138 during the assembly and after the assembly of the bearing member 130 relative to the frame member 110.

In the door handle apparatus 100 including the aforementioned construction, circumstances where an excessive load is applied to the handle body 120 in the vehicle rear direction X2 (i.e. in a predetermined direction) are assumed. The aforementioned circumstances may occur, for example, at a time of vehicle theft or during a normal door opening and closing operation performed by a user holding or retaining the handle body 120 with one's hand and fingers. In this case, the handle shaft portion 122 is operated in the same direction as the handle body 120 to thereby bias the pair of holding portions 135, 135 of the bearing member 130 in the vehicle rear direction X2. At each of the holding portions 135 of the bearing member 130, the inner wall surface 137*a* of the restriction wall portion 137 is pressed by the handle shaft portion 122 of the handle body 120 in the vehicle rear direction X2 so that the side wall portion 136 or the restriction wall portion 137 may be possibly elastically deformed with reference to the support shaft portion 134. At this time, in a case where one of and the other of the holding portions 135, 135 separate from each other and thus a clearance therebetween is expanded, i.e., an opening state of the bearing member 130 is formed, the handle shaft portion 122 of the handle body 120 may disengage or separate from each of the holding portions 135 to thereby easily release the holding of the handle shaft portion 122 by the bearing member 130.

In addition, because of a load causing the handle shaft portion 122 of the handle body 120 to disengage and separate from the holding portions 135 in the vehicle rear direction X2, the bearing member 130 may possibly rotate from the assembly completion position to the assembly ready position. Specifically, in a case where a construction where the inner wall surface 137*a* of the restriction wall portion 137 is inclined relative to the arrows X1 and X2 in the front-rear direction of the vehicle in a state where the bearing member 130 is in the assembly completion position is employed for the purposes of increase of assembly performance of the handle body 120, the bearing member 130 may easily rotate from the assembly completion position to the assembly ready position by the load in the vehicle rear direction X2 applied to the inner wall surface 137*a* of the restriction wall portion 137 from the handle shaft portion 122. In this case, the insertion opening 135*b* connecting to the holding void 135*a* for housing the handle shaft portion 122 opens in the vehicle rear direction X2. Thus, the holding of the handle shaft portion 122 by the bearing member 130 is also easily released because the handle shaft portion 122 of the handle body 120 disengages and separates from each of the holding portions 135. As a result, malfunctions such as an occurrence of looseness at the handle body 120 and a disengagement (removal) of the handle body 120 from the door outer panel 11, for example, may occur.

Therefore, in order to inhibit or restrain the aforementioned malfunctions, in the door handle apparatus 100 of the embodiment, a first holding release inhibition mechanism 140 and a second holding release inhibition mechanism 150 are provided at the bearing member 130. Each of the first holding release inhibition mechanism 140 and the second holding release inhibition mechanism 150 functions as inhibiting or blocking a release of a state where the handle shaft portion 122 is held at the holding void 135*a* by restricting the operations of the pair of holding portions 135, 135 in a case where the handle body 120 receives the load in the vehicle rear direction X2 (i.e., in the predetermined direction) during the opening and closing operation of the vehicle door 10 when the bearing member 130 is in the assembly completion position. Each of the aforementioned holding release inhibition mechanisms 140 and 150 serves as a holding release inhibition mechanism.

As illustrated in FIGS. 4 and 5, the first holding release inhibition mechanism 140 is constituted by the connection portion 138 of the bearing member 130. In a case where the inner wall surface 137*a* of each of the restriction wall portions 137 receives the load from the handle shaft portion 122 in the vehicle rear direction X2, the side wall portion 136 of each of the holding portions 135 may possibly rotate and move in a direction indicated by each solid arrow in FIG. 5 with reference to the support shaft portion 134 together with the restriction wall portion 137 by elastic deformation. That is, the bearing member 130 may be possibly elastically deformed in a manner that one of and the other of the holding portions 135, 135 separate from each other. Because of the aforementioned elastic deformation of the bearing member 130, the clearance between the holding portions 135, 135 increases so that the holding void 135*a* expands.

In this case, the connection portion 138 connects the side wall portion 136 of one of the holding portions 135 and the side wall portion 136 of the other of the holding portions 135 each other. Thus, the connection portion 138 may block or inhibit the operation of the pair of holding portions 135, 135 separating from each other. As a result, the aforementioned opening state of the bearing member 130 is inhibited from being formed and the holding state of the handle shaft portion 122 by the bearing member 130 may be maintained. That is, the connection portion 138 is configured to connect the pair of holding portions 135, 135 each other so as to restrict the expansion of the holding void 135*a* caused by the elastic deformation of the pair of holding portions 135, 135, which are biased by the handle shaft portion 122, in a direction where the holding portions 135, 135 separate from each other (i.e., so as to restrict an operation where the pair of holding portions 135, 135 biased by the handle shaft portion 122 is elastically deformed in a direction separating from each other to thereby expand the holding void 135*a*) in a case where the handle body 120 receives the load in the vehicle rear direction X2.

As a result, the handle shaft portion 122 is inhibited from disengaging or separating form the holding void 135*a* of the bearing member 130 by the excessive load applied to the handle body 120. On the other hand, if the bearing member 130 does not include the connection portion 138, the bearing member 130 is unable to restrict the pair of holding portions 135, 135 from separating from each other. Because the pair of holding portions 135, 135 is likely to be elastically deformed in the direction separating from each other, the handle shaft portion 122 may easily disengage or separate from the holding void 135*a* of the bearing member 130.

As illustrated in FIG. 5, the second holding release inhibition mechanism 150 is constituted by a pair of engagement wall portions 116, 116. Each of the engagement wall portions 116 serves as an engagement wall portion. Each of the engagement wall portions 116 is arranged facing the restriction wall portion 137 that is positioned at the most vehicle rear side in each of the holding portions 135 of the bearing member 130 when the bearing member 130 is in the assembly completion position. Each of the engagement wall portions 116 is configured to be arranged so as not to interfere or block the operation of the restriction wall portion 137 in a case where the bearing member 130 rotates from the assembly ready position as illustrated in FIG. 6 to the assembly completion position as illustrated in FIG. 7. In this case, each of the engagement wall portions 116 may be arranged away from the restriction wall portion 137 by a predetermined interval so as not to interfere with a void (path) where the restriction wall portion 137 passes, i.e., so as not to make contact with the restriction wall portion 137, or may be arranged to make contact with the restriction wall portion 137 to the extent not to block the rotation of the bearing member 130 during the assembly of the bearing member 130 relative to the frame member 110. In a case where the inner wall surface 137*a* of the restriction wall portion 137 receives the load from the handle shaft portion 122 in the vehicle rear direction X2, the restriction wall portion 137 of each of the holding portions 135 may be possibly elastically deformed in the direction indicated by each hollow arrow in FIG. 5. In this case, each of the engagement wall portions 116 that directly makes contact with the restriction wall portion 137 via a contact surface 116*a* includes a counterbalancing rigidity against the load from the restriction wall portion 137. Accordingly, even though the restriction wall portion 137 is elastically deformed in the vehicle rear direction X2, the degree of the aforementioned elastic deformation may be restrained to be low. As a result, in the same way as a case where the first holding release inhibition mechanism 140 is used, the aforementioned opening state of the bearing member 130 is inhibited form being formed, thereby maintaining the holding state of the handle shaft portion 122 by the bearing member 130.

Figure 8:
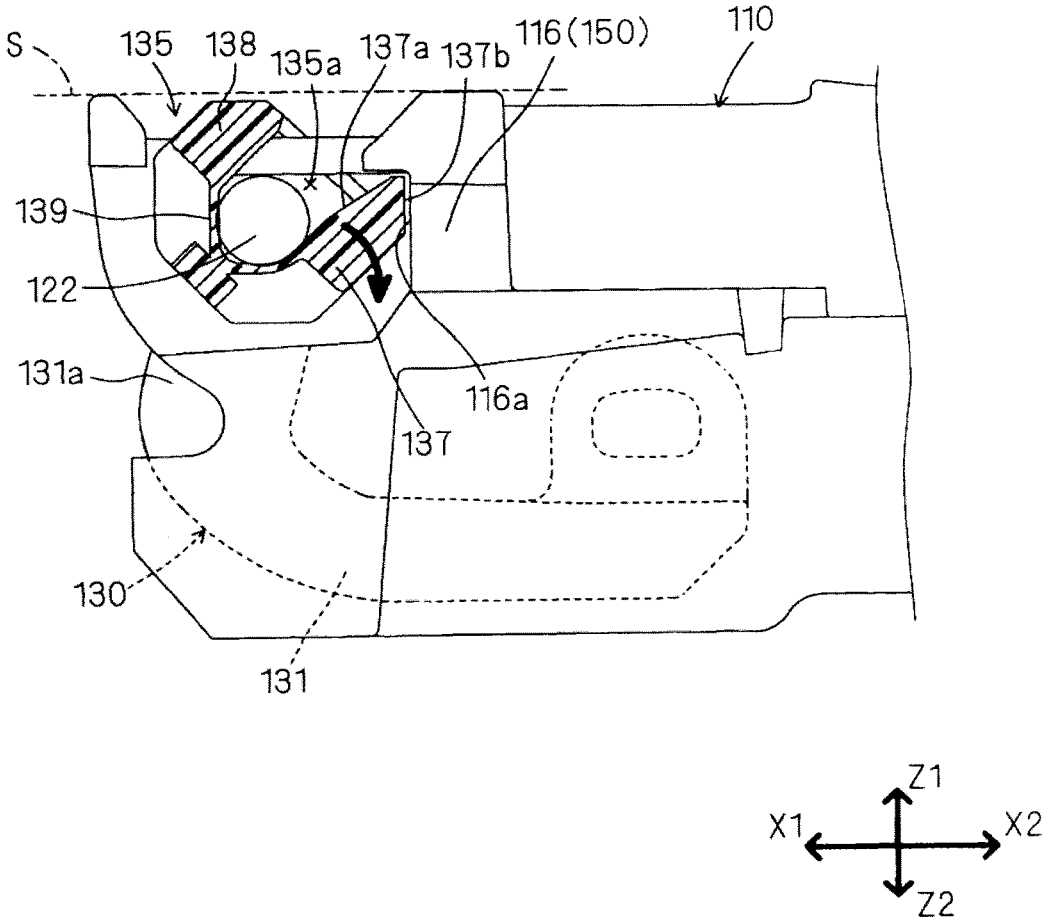
FIG. 8 is a schematic view illustrating an arrangement relation between the bearing member in FIG. 7 and the frame member.

Further, as illustrated in FIG. 8, the engagement wall portions 116 constituting the second holding release inhibition mechanism 150 function as blocking or restraining a rotation operation (operation in a direction of an arrow in FIG. 8) of the bearing member 130 that is biased by the handle shaft portion 122 from the assembly completion position to the assembly ready position illustrated in FIG. 6 in a case where the handle body 120 receives the load in the vehicle rear direction X2. In order to achieve the aforementioned function, the engagement wall portion 116 is inhibited from blocking the operation of the restriction wall portion 137 during the assembly of the bearing member 130 on the frame member 110 as mentioned above. Nevertheless, in a case where the restriction wall portion 137 is biased by the handle shaft portion 122 to be elastically deformed in the vehicle rear direction X2, the engagement wall portion 116 is configured and arranged to make contact (engages) with an outer wall surface 137*b* of the restriction wall portion 137 to block the operation of the restriction wall portion 137. Specifically, because of the thin wall portion 139 formed relative to the connection portion 138, the restriction wall portion 137 is likely to be elastically deformed in the vehicle rear direction X2 even by a small biasing force from the handle shaft portion 122 and the amount of elastic deformation of the restriction wall portion 137 increases. As a result, the outer wall surface 137*b* of the restriction wall portion 137 may easily make contact with the contact surface 116*a* of the engagement wall portion 116. In this case, the thin wall portion 139 functions as assisting or helping the restriction wall portion 137 so that the restriction wall portion 137 is easily elastically deformed, in addition to functioning as substantially a plate spring. As a result, an effect that the rotation operation of the bearing member 130 rotating towards the assembly ready position may be securely blocked or inhibited is obtained.

In order to enhance the aforementioned effect, the engagement wall portion 116 and the restriction wall portion 137 are desirably configured so that a contact area between the contact surface 116*a* and the outer wall surface 137*b* is enlarged. In this case, typically, the engagement wall portion 116 and the restriction wall portion 137 may be configured so that the contact surface 116*a* and the outer wall surface 137*b* extend substantially parallel to each other. Accordingly, the rotation of the bearing member 130 to a position at which the handle shaft portion 122 is allowed to separate from the holding portions 135 is blocked or inhibited by the engagement wall portions 116, thereby maintaining the holding state of the handle shaft portion 122 by the bearing member 130.

In addition, specifically, a usage of the construction where both the aforementioned first and second holding release inhibition mechanisms 140 and 150 are included increases the effect for maintaining the holding state of the handle shaft portion 122 by the bearing member 130. As a result, in the same way as using the connection portion 138, the handle shaft portion 122 is inhibited from disengaging or separating from the holding void 135*a* of the bearing member 130 by the excessive load applied to the handle body 120.

Figure 9:
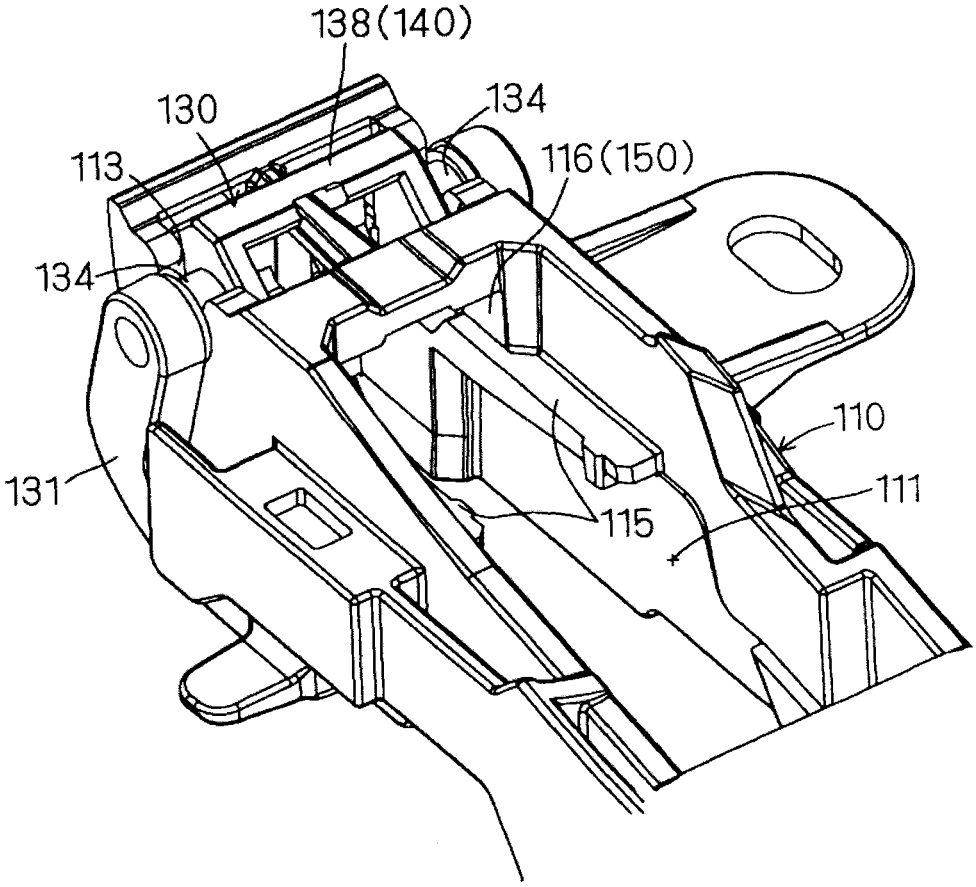
FIG. 9 is a perspective view illustrating configurations of a guide portion and an engagement wall portion of the frame member in FIG. 5.

It is desirable that the engagement wall portions 116 are integrally formed with a guide portion 115 formed at the frame member 110 in a state being positioned at the vehicle front side relative to the guide portion 115 as illustrated in FIGS. 5 and 9. The guide portion 115 extends to be elongated along the arrows X1 and X2 in the front-rear direction of the vehicle and functions as a guide rail guiding the handle shaft portion 122 of the handle body 120 towards the holding void 135*a* of the bearing member 130 in the vehicle front direction. The guide portion 115 serves as a guide portion. Thus, while being in contact with an upper surface of the guide portion 115, the handle shaft portion 122 of the handle body 120 slides in the vehicle front direction along the aforementioned upper surface to thereby assemble the handle shaft portion 122 on the bearing member 130.

In this case, as illustrated in FIG. 5, the frame member 110 is dimensionally specified so that an interval d2 between respective inner wall surfaces 116*b*, 116*b* of one of and the other of the engagement wall portions 116, 116 is greater than a shaft length d1 of the handle shaft portion 122. Accordingly, the load received by each of the engagement wall portions 116 of the frame member 110 from the restriction wall portion 137 of the bearing member 130 in the vehicle rear direction X2 may be received by the guide portion 115 that extends to be elongated along the arrows X1 and X2 in the front-rear direction of the vehicle. As a result, the rigidity of the construction for receiving the load in the vehicle rear direction X2 from the restriction wall portions 137 of the bearing member 130 may be enhanced. In addition, the aforementioned construction is achievable by a portion of the guide portion 115.

The present embodiment is not limited to include the aforementioned construction and may be appropriately changed or modified as below.

In the above, according to the embodiment, the operation of the bearing member 130 in a case where the handle body 120 receives the load in the vehicle rear direction is explained. Alternatively, the direction where the load is applied to the handle body 120 may be the vehicle front direction, the vehicle upper direction or the vehicle lower direction, for example, instead of the vehicle rear direction.

In addition, in the embodiment, the first and second holding release inhibition mechanisms 140 and 150 restrict the operations of both the pair of holding portions 135, 135. Alternatively, various constructions where the first and second holding release inhibition mechanisms 140 and 150 restrict at least the operation of one of the holding portions 135 may be employed. For example, a construction where one of the pair of engagement wall portions 116 of the second holding release inhibition mechanism 150 is omitted and the single engagement wall portion 116 blocks or inhibits the rotation operation of the bearing member 130 may be employed.

Further, in the embodiment, the door handle apparatus 100 includes both the first holding release inhibition mechanism 140 and the second holding release inhibition mechanism 150. Alternatively, one of the first holding release inhibition mechanism 140 and the second holding release inhibition mechanism 150 may be omitted.

Furthermore, in the frame member 110 of the embodiment, the engagement wall portions 116 are integrally formed with the guide portion 115. Alternatively, the engagement wall portions 116 may be positioned and arranged apart from the guide portion 115.

Furthermore, in the bearing member 130 of the embodiment, the connection portion 138 includes the chamfer configuration obtained by the first plane 138*a* and the second plane 138*b* at the vehicle exterior surface. The configuration of the vehicle exterior surface of the connection portion 138 is not limited to the above and may be variously changed as necessary. For example, instead of the chamfer configuration where the connection portion 138 is inhibited from projecting to the vehicle outer side than the frame member 110 only when the bearing member 130 is in each of the assembly completion position and the assembly ready position, a chamfer configuration where the connection portion 138 is inhibited from projecting to the vehicle outer side than the frame member 110 when the bearing member 130 is in any position between the assembly completion position and the assembly ready position. In addition, as long as a construction where the connection portion 138 is inhibited from protruding to the vehicle outer side than the frame member 110 is obtained, the first plane 138*a* and the second plane 138*b* may be obtained by a continuous single plane which is formed by a curved surface, regardless of the chamfer configuration.

In the present embodiment, the construction of the door handle apparatus 100 is applicable to each vehicle door for a vehicle. For example, the construction of the door handle apparatus 100 is applicable to each of left and right doors for a front seat of a vehicle, each of left and right doors for a rear seat of a vehicle, or a door at a vehicle rear portion (a backdoor or a hatchback), for example.

According to the door handle apparatus 100 of the present embodiment, in a case where the handle body 120 receives the load in the vehicle rear direction X2 (i.e., the predetermined direction), the handle shaft portion 122 is also operated in the same direction as the handle body 120 to thereby bias the pair of holding portions 135, 135 of the bearing member 130. At this time, the operation of at least one of the holding portions 135 is restricted by the first and second holding release inhibition mechanisms 140 and 150 so as to inhibit the release of the state where the handle shaft portion 122 is held at the holding void 135*a*. As a result, the handle shaft portion 122 may be inhibited from disengaging or separating from the holding void 135*a* of the bearing member 130 by the excessive load applied to the handle body 120.

In addition, in the embodiment, the bearing member 130 includes the connection portion 138 connecting the pair of holding portions 135, 135 each other to restrict the expansion of the holding void 135*a* caused by the elastic deformation of the holding portions 135, 135 in a direction where the holding portions 135, 135 separate from each other, the holding portions 135, 135 being biased by the handle shaft portion 122 in a case where the handle body 120 receives the load in the vehicle rear direction X2. The first holding release inhibition mechanism 140 is configured by the connection portion 138 of the bearing member 130.

Accordingly, the expansion of the holding void 135*a* because of the separation between the pair of holding portions 135, 135 in a case where the handle body 120 receives the load in the vehicle rear direction X2 is restrained by the connection portion 138. As a result, the opening state of the bearing member 130 is inhibited from being formed, thereby inhibiting the handle shaft portion 122 from disengaging or separating from the holding void 135*a* of the bearing member 130.

Further, in the embodiment, the connection portion 138 includes the vehicle exterior surface, and the plane positioned at the vehicle outermost side in the vehicle exterior surface is placed at the vehicle inner side relative to the reference surface S that specifies the outermost portion at the vehicle outer side of the frame member 110 in a case where the bearing member 130 is positioned at least at one of the assembly completion position and the assembly ready position Accordingly, the connection portion 138 may be inhibited from interfering with the surrounding members thereof during the assembly and after the assembly of the bearing member 130 relative to the frame member 110.

Furthermore, in the embodiment, the frame member 110 includes the engagement wall portions 116 engaging with at least one of the holding portions 135, 135 to restrict the rotation operation of the bearing member 130 from the assembly completion position to the assembly ready position in a case where the handle body 120 receives the load in the vehicle rear direction X2 and at least the one of the holding portions 135, 135 is biased by the handle shaft portion 122. The second holding release inhibition mechanism 150 is configured by the engagement wall portions 116 of the frame member 110.

Accordingly, the bearing member 130 at the assembly completion position is inhibited from rotating to the assembly ready position by the load which is applied to the holding portions 135, 135 and which causes the handle shaft portion 122 of the handle body 120 to disengage or separate from the holding void 135*a*. As a result, the handle shaft portion 122 may be inhibited from disengaging or separating from the holding void 135*a* of the bearing member 130.

Furthermore, in the embodiment, the frame member 110 includes the guide portion 115 extending in the elongated form along the vehicle rear direction X2 to guide the handle shaft portion 122 of the handle body 120 towards the holding void 135*a* of the bearing member 130, the guide portion 115 being integrally formed with the engagement wall portion 116.

Accordingly, the guide portion 115 in the elongated form may receive the load applied to the engagement wall portions 116, 116 of the frame member 110 from the bearing member 130. Thus, the rigidity of the construction for receiving the load from the bearing member 130 may be enhanced. In addition, the aforementioned construction is achievable by a portion of the guide portion 115.

Furthermore, in the embodiment, each of the holding portions 135, 135 of the bearing member 130 includes the restriction wall portion (first wall portion) 137, the connection portion (second wall portion) 138 which are arranged facing each other, and the thin wall portion 139 extending between the restriction wall portion 137 and the connection portion 138 and being configured to deform by a contact with the handle shaft portion 122 held at the holding void 135*a*, the restriction wall portion 137, the connection portion 138 and the thin wall portion 139 defining the holding void 135*a* for holding the handle shaft portion 122.

Accordingly, even in a case where variations in product size occurs at the handle shaft portion 122 that is housed in the holding void 135*a*, the thin wall portion 139 is deformed at a contact portion relative to the handle shaft portion 122 to thereby absorb the aforementioned variations. As a result, in a state where the handle body 120 is assembled on the frame member 110, a looseness of the handle shaft portion 122 may be inhibited.

Furthermore, in the embodiment, the connection portion 138 includes the first plane 138*a* configured to be positioned at the vehicle outermost side in the vehicle exterior surface of the connection portion 138 in a case where the bearing member 130 is at the assembly ready position, the first plane 138*a* being placed at the vehicle inner side relative to the reference surface S in a case where the bearing member 130 is at the assembly ready position. The connection portion 138 includes the second plane 138*b* configured to be positioned at the vehicle outermost side in the vehicle exterior surface of the connection portion 138 in a case where the bearing member 130 is at the assembly completion position, the second plane 138*b* being placed at the vehicle inner side relative to the reference surface S in a case where the bearing member 130 is at the assembly completion position.

Accordingly, the connection portion 138 may be inhibited from interfering with the surrounding members thereof during the assembly and after the assembly of the bearing member 130 relative to the frame member 110.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle apparatus for a vehicle, comprising:

a frame member configured to be assembled on a door outer panel that constitutes an outer surface of a vehicle door;

a handle body including an arm portion that extends towards the frame member and that includes a handle shaft portion, the handle body being rotatable relative to the frame member at the handle shaft portion;

a bearing member assembled on the frame member and holding the handle shaft portion of the handle body, the bearing member being made of resin, the bearing member including a first movable arm spaced apart from and connected to a second movable arm, the bearing member further including first and second holding portions arranged away from each other in a rotation axis direction of the handle shaft portion that is held at the bearing member, the first and second holding portions defining a holding void for holding the handle shaft portion, the first and second holding portions each extending by a predetermined amount so as to be close to each other, the first and second holding portions being formed to as to cover opposing end portions of the handle shaft portion in the rotation axis direction over a circumference of the handle shaft portion by a predetermined amount, and the bearing member being supported at the frame member in a state where the bearing member is rotatable between an assembly completion position at which a disengagement of the handle shaft portion from the holding void is restricted and an assembly ready position at which the disengagement of the handle shaft portion from the holding void is inhibited from being restricted, and a holding release inhibition mechanism inhibiting a release of a state where the handle shaft portion is held at the holding void by restricting an operation of at least one of the first and second holding portions in a case where the handle body receives a load in a predetermined direction along an extending longitudinal direction of the handle body while the bearing member is at the assembly completion position, wherein the frame member includes an engagement wall portion engaging with at least one of the first and second holding portions to restrict a rotation operation of the bearing member from the assembly completion positon to the assembly ready positon in a case where the handle body receives the load in the predetermined direction and at least the one of the first and second holding portions is biased by the handle shaft portion, the at least one of the first and second holding portions being positioned between the handle shaft portion and the engagement wall portion, wherein the frame member includes an engagement portion that engages with the first moveable arm and the second movable arm to help support the bearing member in the assembly completion positon, and the holding release inhibition mechanism includes the engagement wall portion of the frame member.

2. The door handle apparatus according to claim 1, wherein the bearing member includes a connection portion connecting the first and second holding portions each other to restrict an expansion of the holding void caused by an elastic deformation of the first and second holding portions in a direction where the first and second holding portions separate from each other, the first and second holding portions being biased by the handle shaft portion in a case where the handle body receives the load in the predetermined direction, and the holding release inhibition mechanism includes the connection portion of the bearing member.

3. The door handle apparatus according to claim 2, wherein the connection portion includes a side surface facing in a vehicle exterior direction, and a plane positioned at a vehicle outermost side along the side surface is placed at a vehicle inner side relative to a reference surface that specifies an outermost portion at a vehicle outer side of the frame member in a case where the bearing member is positioned at least at one of the assembly completion position and the assembly ready position.

4. The door handle apparatus according to claim 3, wherein the connection portion includes a first plane configured to be positioned at the vehicle outermost side in the vehicle exterior surface of the connection portion in a case where the bearing member is at the assembly ready position, the first plane being placed at the vehicle inner side relative to the reference surface in a case where the bearing member is at the assembly ready position, and the connection portion includes a second plane configured to be positioned at the vehicle outermost side in the vehicle exterior surface of the connection portion in a case where the bearing member is at the assembly completion position, the second plane being placed at the vehicle inner side relative to the reference surface in a case where the bearing member is at the assembly completion position.

5. The door handle apparatus according to claim 1, wherein the frame member includes a guide portion extending in an elongated form along the predetermined direction to guide the handle shaft portion of the handle body towards the holding void of the bearing member, the guide portion being integrally formed with the engagement wall portion.

6. The door handle apparatus according to claim 1, wherein each of the first and second holding portions of the bearing member includes a first wall portion, a second wall portion which are arranged facing each other, and a reduced wall portion extending between the first wall portion and the second wall portion and being configured to deform by a contact with the handle shaft portion held at the holding void, the first wall portion, the second wall portion and the reduced wall portion defining the holding void for holding the handle shaft portion.

7. The door handle apparatus according to claim 1, wherein the engagement wall portion protrudes by a predetermined amount so as to be in contact with the at least one of the first and second holding portions.

* * * * *